United States Patent [19]

Kettelkamp, Sr. et al.

[11] Patent Number: 4,666,131

[45] Date of Patent: May 19, 1987

[54] ADJUSTABLE GUARD RAIL STANCHION MEMBER

[76] Inventors: Ronald C. Kettelkamp, Sr., 5711 W. Ave. M, Space 136, Quartz Hill, Calif. 93536; Maurice Shaffstall, 1435 W. Avenue, H-9, Lancaster, Calif. 93534

[21] Appl. No.: 855,440

[22] Filed: Apr. 24, 1986

[51] Int. Cl.[4] ..... E04H 17/14

[52] U.S. Cl. ..... 256/59; 256/DIG. 6; 182/113

[58] Field of Search ..... 256/DIG. 6, 59; 182/113; 248/228

[56] References Cited

U.S. PATENT DOCUMENTS

| | | | |
|---|---|---|---|
| 3,082,843 | 3/1963 | Leonard | 182/113 X |
| 3,747,898 | 7/1973 | Warren | 256/59 |
| 3,880,405 | 4/1975 | Brueske | 256/59 |
| 3,901,481 | 8/1975 | Probst | 256/59 |
| 3,995,833 | 12/1976 | McLaughlin | 256/59 |
| 4,236,698 | 12/1980 | Compte | 256/23 |

*Primary Examiner*—Andrew V. Kundrat

*Attorney, Agent, or Firm*—Harlan P. Huebner

[57] ABSTRACT

An adjustable guard rail stanchion member for use on pitched or flat roofs with clamping means to engage a rafter of a roof or elevated floor. Adjustable means are provided to assure a vertical position of a portion of the stanchion member yet allowing another portion to be angled to the pitch of the rafter. In addition the stanchion member is spaced outwardly of the roof or floor so as to not interfere with roofing operations.

8 Claims, 4 Drawing Figures

ADJUSTABLE GUARD RAIL STANCHION MEMBER

BACKGROUND OF THE INVENTION

1. Field of the Invention

This invention relates to an adjustable guard rail stanchion member adapted for use on pitched roofs or flat elevated surfaces.

2. Description of the Prior Art

With the application of roofing to a building whether it be on a pitched or flat roof it is desirable to have some form of perimeter barricade to prevent a workman or materials from falling off. Governmental agencies such as the Federal or states Occupational Safety and Health Agencies (OSHA) and insurance companies are becoming concerned with accidents that occur with roofers falling off of roofs because of the lack of safety barricades on building roofs.

There have been previous roof or high-rise floor stanchions developed in the past. However, each of them have characteristics whereby they cannot be adapted for roofs of varying pitch or for flat roofs and high-rise building floors.

Applicants are aware of U.S. Pat. No. 3,901,481 which illustrates a number of stanchions mounted on a roof and are joined by barricade pipes. This patent requires a permanent type of support mounted on the roof. It not only creates the possibility of damage of the roof upon removal, but does not extend beyond the edge of the roof so finishing of the roofing to the edge is impossible. Further, there do not appear to be any adjustable mounting features depending on roof pitch.

In the case of U.S. Pat. No. 4,236,698 the railing requires that the vertical posts be embedded in a hole in a concrete floor.

Applicants are also aware of three clamp type of patents mainly U.S. Pat. Nos. 3,747,898; 3,880,405; and 3,995,833. In none of these patents are the clamping members for other than horizontal flooring and none appear to contain means for adjustment as to pitch.

SUMMARY OF THE INVENTION

It is the purpose of the present invention to provide an adjustable guard rail stanchion member which is capable of affixation to a roof in other than the area to be roofed and is spaced from the roof edge so as not to interfere with roofing to the edge of a roof.

Another object of the present invention is to provide a plurality of spaced apart adjustable guard rail stanchions which receive rail members to prevent men and material from falling off a pitched or flat roof.

A still further object of the present invention is to provide adjustable clamping means on a stanchion member to be effectively used on roofs of varying pitches.

Another purpose of the present invention is to provide an adjustable guard rail stanchion which includes adjustable rail holding means which can be moved so that rails mounted therein can be shifted to prevent men and materials from falling off the edge of a roof.

These and other objects and advantages will become apparent from the following part of the specification wherein details have been described for the competence of disclosure, without intending to limit the scope of the invention which is setforth in the appended claims.

BRIEF DESCRIPTION OF THE DRAWINGS

These advantages may be more clearly understood from the following detailed description and by reference to the drawings in which.

DETAILED DESCRIPTION OF THE PREFERRED EMBODIMENT

Figure 2:
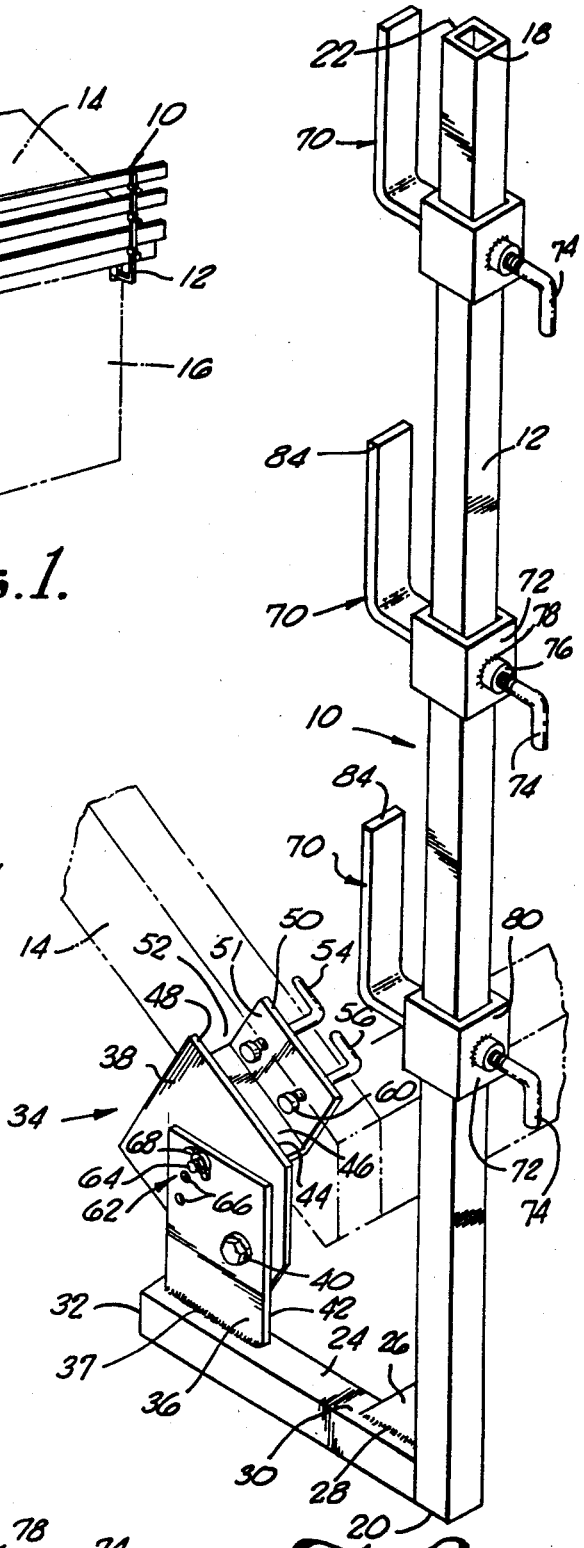
FIG. 2 is a perspective view of a stanchion member of the present invention.

Referring to the drawings and more particularly to FIG. 2, there is illustrated an adjustable guard rail stanchion member general designated 10 which includes an upright post member 12 preferably formed of square hollow bar stock steel. The post member 12 is of a height to form a sufficient barricade to prevent a human from falling off the roof and to be affixed to rafter 14 of a building 16. It has been found that a post of approximately 42 inches in height will suffice. The post member 12 includes a top end 18 and a bottom end 20.

Extending normal to the elongated plane of the post member 12 from surface 22 adjacent end 20 is a mounting or spacer strut 24. The strut as with the post 12 is preferably square hollow bar stock steel and may be welded or otherwise secured to the surface 22 of the member 12.

Figure 3:
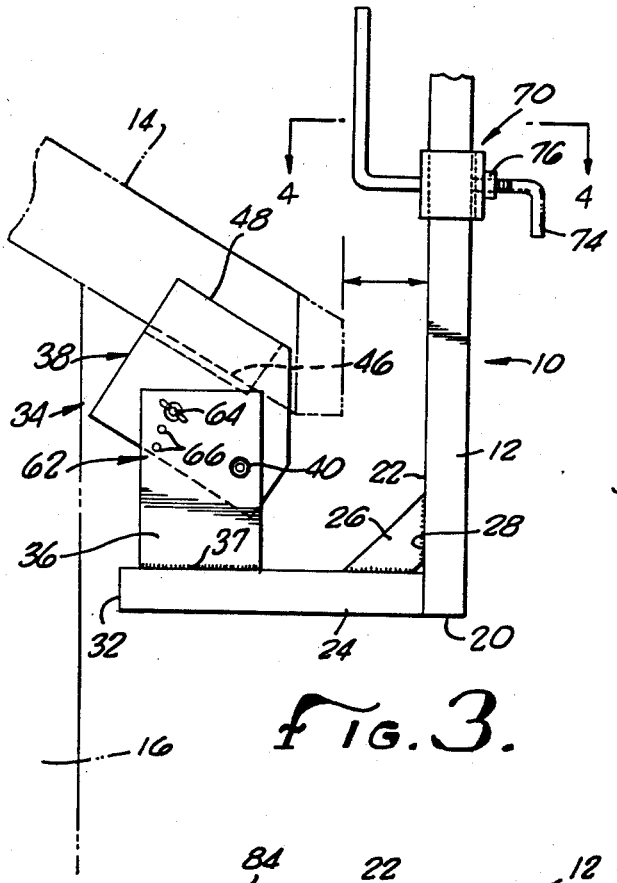
FIG. 3 is a side elevational view of a stanchion member mounted on a roof.

As shown in FIGS. 2 and 3 a strengthening gusset 26 may be secured by welding 28 or otherwise to surface 22 of the post 12 and surface 30 of strut 24.

Mounted adjacent end 32 of strut 24 is an adjustable clamping means 34. The clamping means 34 includes an elongated fixed plate support arm 36. The support arm 36 is welded as at 37 to the top surface 28 of strut 24.

The support arm 36 has an inner surface 42 and an outer surface. Pivotally connected to the arm 36 and bearing against the inner surface 42 is a pivot plate 38. The plate is held to arm 36 by means of a pivot bolt 40 passing through the arm 36 and plate 38. A nut (not shown) is secured on the inner side to the bolt. In this construction the pivot plate 38 is free to pivot about bolt 40.

Extending inwardly from the inner surface 42 of pivot plate 38 is a channel bottom plate 46. The channel bottom plate 46 is preferably parallel with top edge 48 of plate 38. Spaced from surface 42 is an outer channel side wall 50 having an inner surface 51.

Thus, formed between surface 44, the channel bottom plate 46 and the inner surface 51 is a rafter receiving channel 52.

In order to mount the adjustable clamping means 34 to a rafter 14 there are provided one or more clamping means 54 which preferably include a threaded bolt 56 which is threaded into a nut (not shown) which is welded or otherwise secured to the outer channel side wall 50. The bolt 56 will extend through the wall 50 and may include a rafter engaging head 60 with a larger circumference than the bolt 56 to engage the side of a rafter 14 and clamp the same against plate 38.

The clamping means 34 is adjustable relative to upright arm 36 through adjustment means 62. The adjustment means 62 includes a pin 64 which extends through the arm 36 and pivot plate 38. The arm 36 also includes a number of pin setting openings 66 so that the pivot plate 38 may be rotated on pivot pin 40 dependent upon the pitch of the roof. Once the proper adjustment is realized a lock nut 68 is secured to the pin 64 to stabilize the stanchion member 10.

It is well known that roofs of buildings are angled or pitched with regard to the horizontal. A common pitch is known as "5 and 12". This means that for every 12" of roof it will rise 5". A 45 degree pitch is known as "12 and 12".

Thus, when it is desired to set a stanchion member in place, the rafter 14 is placed within the channel 52 engaging side 44 and bottom 46 and the bolts 56 are tightened to secure the clamp. The pin 64 is removed and the plate 38 is pivoted upward or downward to the rafter angle, as best seen in FIGS. 2 and 3. The pin 64 is then passed through one of the adjustment openings 66 and secured. With the strut 24 being of a sufficient length it can be seen that the post 12 will actually be spaced outwardly away from the roof. This construction will allow the roofer to apply roofing to the edge of the roof without interference, something not possible in some of the prior art.

Figure 4:
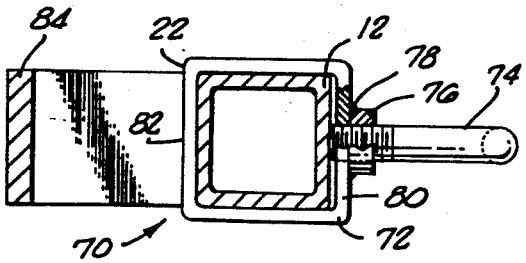
FIG. 4 is a cross-sectional view taken on line 4—4 of FIG. 3.

Mounted on the upright post member 12 are guard rail receiving members generally designed 70. Each of the members 70 include a collar 72 which surrounds the post 12 and will slide thereon, see FIG. 4. In order to set the collars 72 at the desired location on the post a set screw 74 is threadable mounted in nut 76 secured to the post by weld 78 or other means and passes through the back side 80 of the collar to engage the post 12. Projecting from the front face 82 of the collar 72 is an L shaped support guard rail bracket 84 to receive a 2×4 or other rail material 86.

Figure 1:
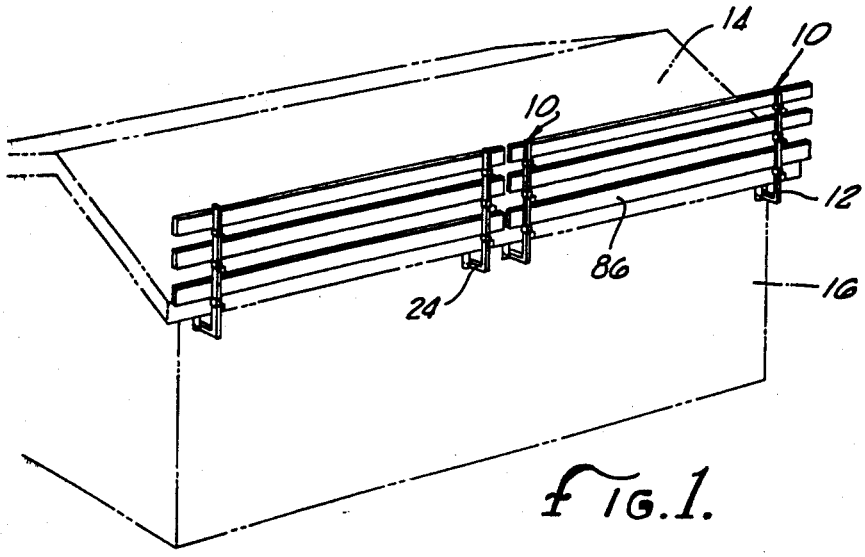
FIG. 1, is an environmental view of several adjustable guard rail stanchion members of the present invention mounted on a building roof with guard rails extending therebetween.

Once the stanchion member 10 is in place then several other stanchion members 10 are mounted to rafters 14 along the edge of the roof as seen in FIG. 1. They are each adjusted and the guard rail receiving members 70 are positioned. It is preferable that there be one near the bottom of the stanchion 12 close to the edge of the roof. In this way when the rail 86 is placed in the guard rail brackets 84, tools and material will be prevented from sliding off the roof.

The additional guardrail receiving members 70 are positioned higher up on the post so that the rails extending therebetween will prevent a person from falling from the roof.

While most of the emphasis has been directed to pitched roofs the invention can be used equally well on a roof or floor that is flat. In that case more pin setting adjustment openings can be provided so that the post 12 may be moved to the vertical.

The invention and its attendant advantages will be understood from the foregoing description and it will be apparent that various changes may be made in the form, construction and arrangements of the parts without departing from the spirit and scope thereof or sacrificing its materials advantages, the arrangements herein before described being merely by way of example. We do not wish to be restricted to the specific forms shown or uses mentioned, except as defined in the accompanying claims, wherein various portions have been separated for clarity of reading and not for emphasis.

We claim:

1. An adjustable safety guard rail stanchion member for a building floor or roof which structure has a plurality of floor or roof rafters, and which member when used with additional stanchion members form supports for receiving safety guard rails extending therebetween, said stanchion member comprising:

a safety guard rail upright post member having an upper and lower end and a longitudinal axis;

a fixed spacer strut extending from said post member adjacent said lower end of said post member and preferably normal to the longitudinal axis of said post member;

adjustable clamping means connected to said fixed spacer strut and including a unitary pivotable rafter engaging and receiving portion, adjustment means on said clamping means to lockably set unitary pivotable rafter engaging and receiving portion relative to the angle of said rafter; and at least one guard rail receiving member axially adjustably mounted on said upright post member and releasable lockable thereon.

2. An adjustable safety guard rail stanchion member as defined in claim 1 wherein said fixed spacer strut is of a length to assure a space between said upright post member and the edge of said rafter so that there is no interference with said rafter to complete roofing of said building.

3. An adjustable safety guard rail stanchion member as defined in claim 1 wherein the unitary pivotable rafter engaging and receiving portion of said clamping means adapted to releasably engage a rafter included:

a U shaped channel member to encompass the bottom and sides of said rafter; and at least one clamp engaging one of said rafter sides to bias said rafter against the opposite side.

4. An adjustable safety guard rail stanchion member as defined in claim 3 where there are two clamps.

5. An adjustable safety guard rail stanchion member as defined in claim 1 wherein said adjustable clamping means includes:

a support arm rising from said fixed spacer strut;

a pivot plate including a rafter engaging and receiving channel pivotally secured to said support arm;

a plurality of pin setting openings in said support arm and a bore through said pivot plate and a locking pin insertable through one of said pin setting openings and said bore to lock said pivot plate at a complimentary angle with said rafter and said upright post member will remain generally vertical.

6. An adjustable safety guard rail stanchion member as defined in claim 1 wherein said upright post member is square bar stock.

7. An adjustable safety guard rail stanchion member as defined in claim 1 wherein said guard rail receiving member includes:

a collar slidable mounted on said upright post member;

a set screw to lock said collar on said post; and a guard rail receiving bracket mounted on said collar on the side opposite said set screw.

8. A plurality of adjustable safety guard rail stanchion members each of which is as defined in claim 1 wherein:

each member is mounted on a separate rafter and each are spaced from one another wherein a guard rail extends between at least two of said stanchions.

* * * * *